United States Patent [19]

Ebisawa et al.

[11] Patent Number: 4,519,436

[45] Date of Patent: May 28, 1985

[54] METHOD FOR INJECTING MOLTEN METAL IN VERTICAL DIECASTING MACHINE

[75] Inventors: Masuo Ebisawa; Akio Kawase; Akiyoshi Nakamura, all of Saitama, Japan

[73] Assignee: Honda Giken Kogyo Kabushiki Kaisha, Tokyo, Japan

[21] Appl. No.: 550,907

[22] Filed: Nov. 10, 1983

Related U.S. Application Data

[63] Continuation-in-part of Ser. No. 226,715, Jan. 21, 1981, abandoned.

[30] Foreign Application Priority Data

Jan. 21, 1980 [JP] Japan ..... 55-5442

[51] Int. Cl.[3] ..... B22D 17/12; B22D 17/20; B22D 27/09

[52] U.S. Cl. ..... 164/120; 164/113; 164/305; 164/313

[58] Field of Search ..... 164/113, 120, 305, 312, 164/313, 410

[56] References Cited

U.S. PATENT DOCUMENTS

| | | | |
|---|---|---|---|
| 3,209,416 | 10/1965 | Morton | 164/312 X |
| 3,254,377 | 6/1966 | Morton | 164/312 X |
| 3,349,833 | 10/1967 | Hodler | 164/305 X |

FOREIGN PATENT DOCUMENTS

| | | | |
|---|---|---|---|
| 1156205 | 10/1963 | Fed. Rep. of Germany | 164/312 |
| 53-79728 | 7/1978 | Japan | 164/113 |
| 54-13206 | 5/1979 | Japan . | |
| 980146 | 1/1965 | United Kingdom | 164/120 |

*Primary Examiner*—Nicholas P. Godici
*Assistant Examiner*—J. Reed Batten, Jr.
*Attorney, Agent, or Firm*—Irving M. Weiner; Pamela S. Burt

[57] ABSTRACT

A method for injecting molten metal in a vertical diecasting machine. In order to efficiently produce high quality castings, a molten metal is injected into a mold cavity with the upper part of the mold cavity communicating with the atmosphere, the mold cavity is occluded before the completion of the injection, and then the molten metal is pressurized to suppress the trapping of air or gases in the casting.

4 Claims, 11 Drawing Figures

15
14
13
12
11
2
2b
4
M
9
10
3a
2a
3b
8
6
3
1
7
17
5
16

METHOD FOR INJECTING MOLTEN METAL IN VERTICAL DIECASTING MACHINE

This is a continuation-in-part of application Ser. No. 226,715 filed Jan. 21, 1981 and now abandoned.

BACKGROUND OF THE INVENTION

1. Field of the Invention

The present invention relates to an improved method for injecting a molten metal into the cavity of a mold of a vertical diecasting machine.

2. Description of Relevant Art

Generally, known diecasting methods have various attendant problems in that the air or gases existing in the mold cavity obstruct or resist the flow of the molten metal into all parts of the mold cavity, and the air or gases are likely to be trapped in the casting, forming undesirable cavities and thus degrading the precision and quality of the casting.

In conventional diecasting, to evacuate the air or gases existing in the mold cavity, various methods have been proposed. For example, U.S. Pat. No. 3,209,416 discloses a method wherein a labyrinth passage is formed at the pouring basin through which the air or gases are sucked out by a vacuum device, while in Japanese Patent Publication No. 13206/79 the pouring basin communicates with the circumference of the mold by means of an air vent. The former method is disadvantageous in that it requires a vacuum device and other additional apparatus. Further, complex procedures are required in controlling the casting conditions, handling of the molds and controlling the molten metals, and the cost of the castings is thus adversely affected. The latter method is also disadvantageous, in that evacuation of the air or gases existing in the mold cavity is insufficient since the pressure in the mold cavity increases rapidly when the molten metal is injected into the mold cavity and production of castings of high quality similar to those produced by gravity diecasting (GDC) is difficult since the back pressure which works on the molten metal flowing in the mold cavity causes unbalanced flow of the molten metal, thus promoting the inclusion or trapping of air or gases in the castings.

The present invention provides an improved method of diecasting which eliminates the foregoing disadvantages attendant the above-described conventional methods.

SUMMARY OF THE INVENTION

The present invention provides a method of injecting a molten metal in a vertical diecasting machine, wherein the diecasting machine includes upper and lower mold elements defining a mold cavity, the upper mold element having at least one opening adapted to communicate the mold cavity with the atmosphere; the opening being closable by a sealing member; and the molten metal being injected into the mold cavity from a cylindrical, vertical pouring basin provided in the mold elements, by a plunger slidably fitted in the pouring basin. The method comprises the steps of: opening the opening by movement of the sealing member when the mold elements are closed; injecting the molten metal into the mold cavity by the upward movement of the plunger while the opening is open to the atmosphere; closing the opening by the sealing member immediately before completion of the injection of the molten metal into the mold cavity; and thereafter completing the injection of the molten metal with pressure by further upward movement of the plunger.

An object of the present invention is to provide a method for injecting molten metal in a vertical diecasting machine wherein molten metal is injected into a mold cavity with the upper part of the mold cavity communicating with the atmosphere, the mold cavity is occluded just before the completion of the injection, and then the molten metal is pressurized.

Thus, according to the method of the present invention, the air or gases existing in the mold cavity are evacuated from the mold cavity to the atmosphere with the injection of a molten metal into the mold cavity, thus completely evacuating the air before occluding the mold cavity so as to produce high quality castings without the inclusion or trapping of air.

Further, the method of the present invention requires neither a vacuum device nor any additional apparatus, and provides for mass production of high-quality castings at improved yield rates.

Another object of the present invention is to provide a method for injecting a molten metal capable of producing castings of high quality by pressurizing the molten metal injected in the mold cavity with a stopping member for the opening formed at the upper part of the mold cavity so as to permit the supply of additional molten metal into the mold cavity according to the solidification and shrinkage of the injected molten metal in the mold cavity, thereby preventing the formation of shrinkage cavities.

Still another object of the present invention is to provide a method for injecting a molten metal capable of producing castings of high quality by gently and smoothly supplying the molten metal into the mold cavity by the upward stroke of a plunger fitted in a sleeve which is formed as a pouring basin, thereby preventing and suppressing the formation of air or gas entrapped cavities and laps otherwise caused by the turbulent flow of the molten metal.

A preferred embodiment of the present invention will be described in detail hereinbelow with reference to the accompanying drawings.

BRIEF DESCRIPTION OF THE DRAWINGS

FIG. 2' is a view illustrating an opening formed at the upper part of the mold cavity when occluded by a stopping member, immediately before completion of injection of molten metal into the full space of the mold cavity.

DETAILED DESCRIPTION OF THE INVENTION

Figure 1:
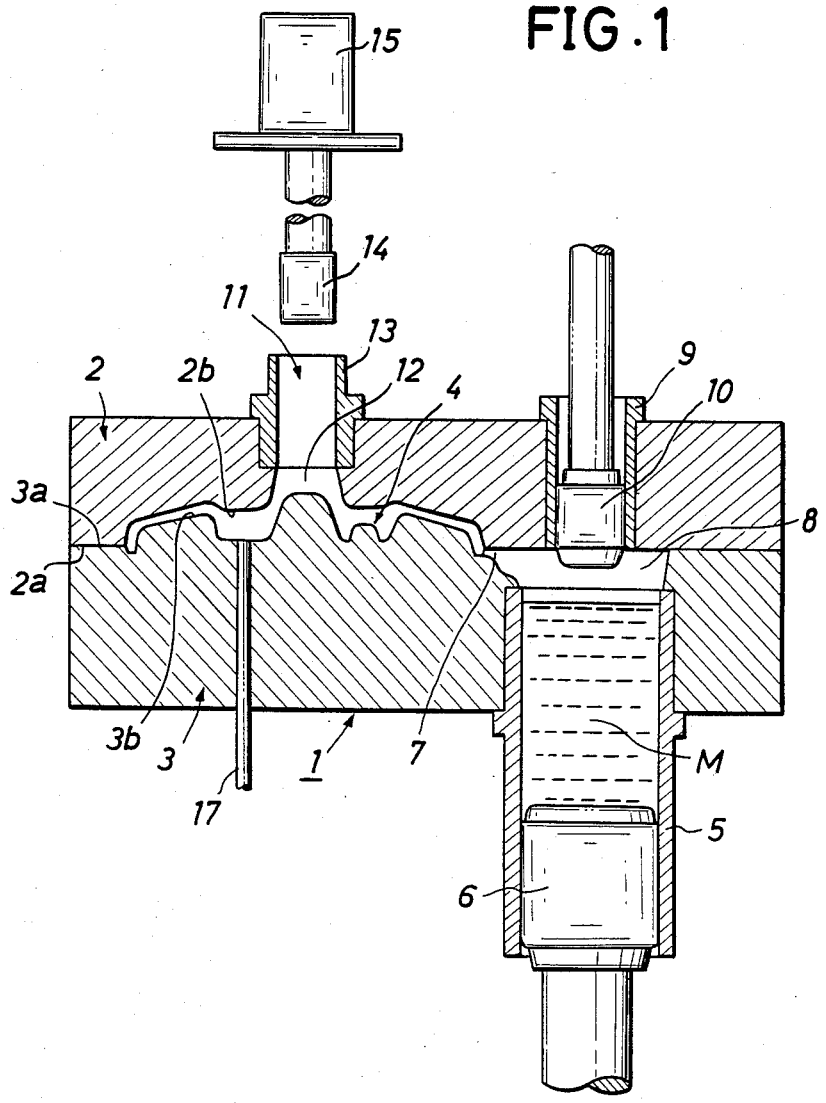
FIG. 1 is a vertical sectional view of a vertical diecasting machine for carrying out the present invention, with the sleeve filled with a molten metal.

Referring first to FIG. 1, a diecasting machine generally designated by reference numeral 1 comprises an upper mold element 2 and a lower mold element 3. On the respective parting surfaces 2*a* and 3*a* a mating cavity 4 is formed by a concave configuration 2*b* and a protruding configuration 3*b*. A lower sleeve 5 defining a pouring basin is vertically fitted in the lower mold element 3. A bottom plunger 6 is snugly and slidably fitted in the lower sleeve 5. The upper end of the sleeve 5 communicates with a space 8 having a runner 7 communicating with the mold cavity 4. The upper surface of the space 8 is defined by the parting surface of the upper mold element 2. A top sleeve 9 is vertically fitted in the upper mold element 2 so as to be concentric with the bottom sleeve 5. A top plunger 10 is slidably fitted in the top sleeve 9. An opening 11 is formed in the upper mold element 2 to provide communication of the mold cavity 4 with the atmosphere and is defined by a sleeve 13 communicating with a space 12 communicating with the upper part of the mold cavity 4. Disposed above the sleeve 13 is a plunger 14 for stopping the opening 11 and pressurizing the molten metal injected into the mold cavity 4. The plunger 14 is operated to move in the vertical direction by a hydraulic cylinder unit 15 or the like, and the opening 11 is opened by the movement of the plunger 14 when the upper and lower mold elements 1 and 2 are closed.

When the top plunger 10 is retained above the top sleeve 9, a molten metal (M) is poured through the top sleeve 9 and filled in the space formed by the bottom sleeve 5 and the upper surface of the bottom plunger 6 located at the lower end of its stroke. After pouring a predetermined amount of the molten metal (M), the top plunger 10 is fitted in the top sleeve 9 and lowered until the bottom surface of the top plunger 10 is disposed so as to be flush with or lower than the parting surface of the upper mold element 2, the completion of which procedure is illustrated in FIG. 1. The top plunger 10 thus functions as a sealing valve during the injecting process.

Figure 2:
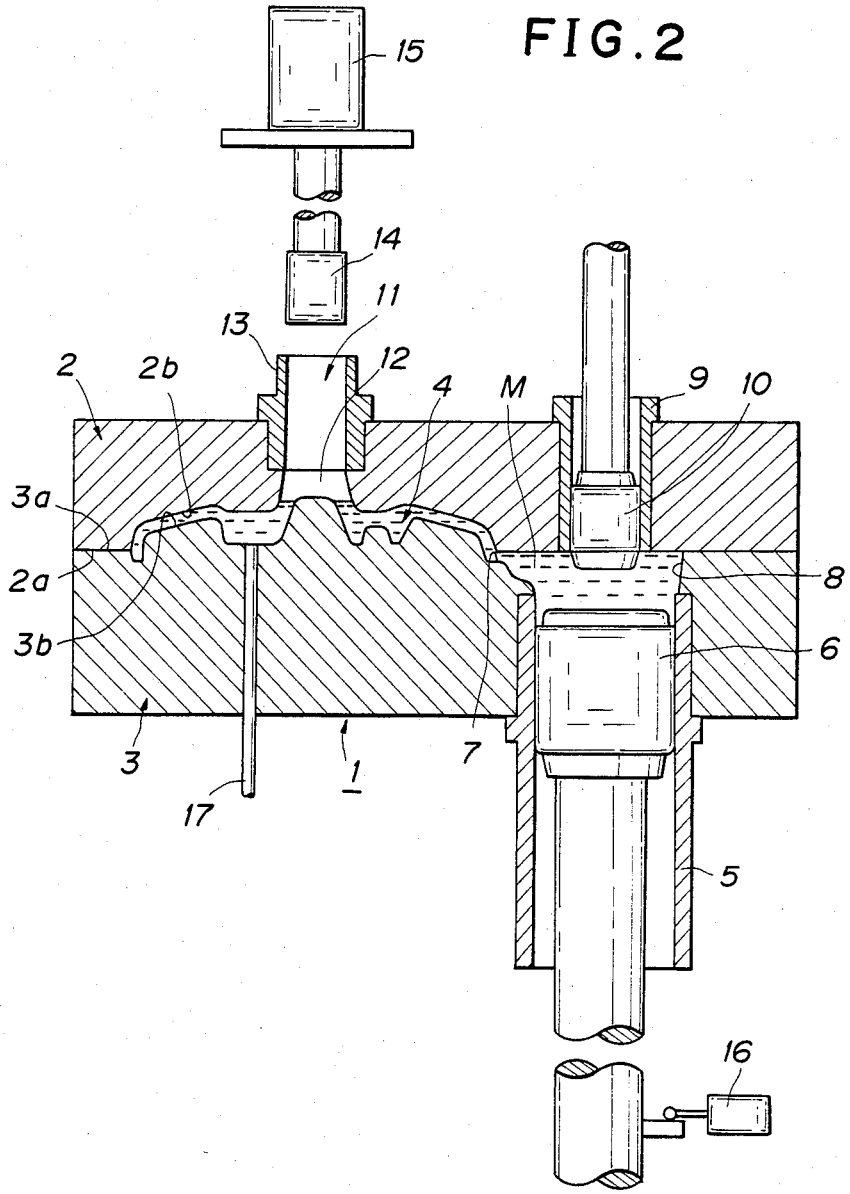
FIG. 2 is a view similar to FIG. 1, showing the plunger rising to inject the molten metal into the mold cavity.
Figure 2:
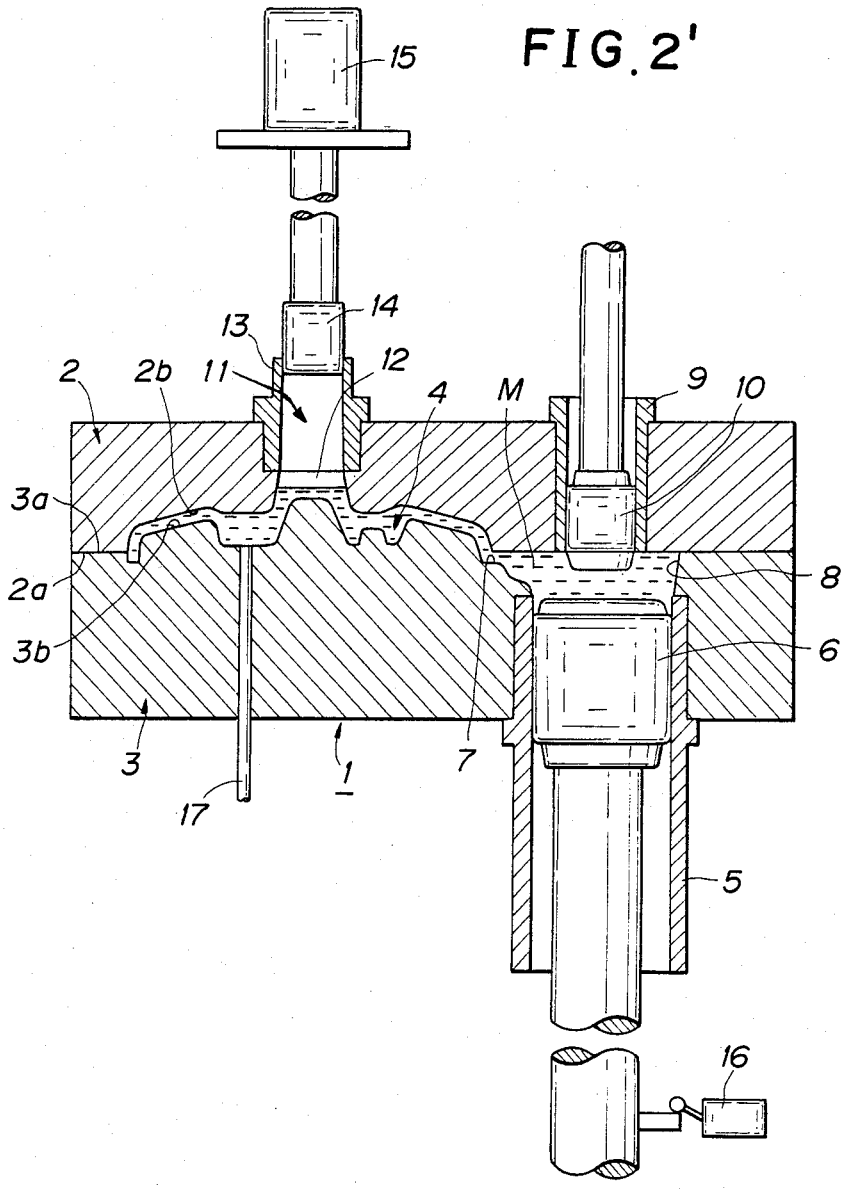
Figure 3:
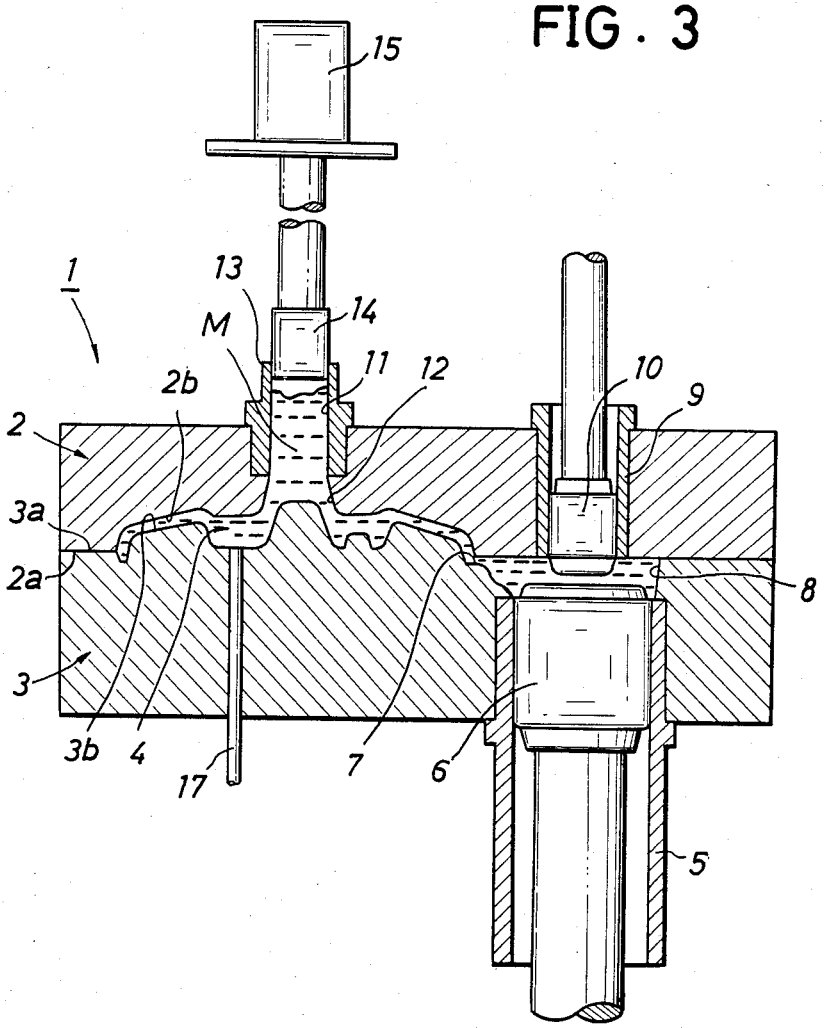
FIG. 3 is a view similar to FIG. 2', showing the opening formed at the upper part of the mold cavity as occluded by the stopping member upon final injection of the molten metal.

After the completion of the state of FIG. 1, the bottom plunger 6 is raised so that the molten metal (M) is gently and smoothly injected into the mold cavity 4 through the runner 7 under the restriction of the top plunger 10, thus filling up the mold cavity 4. During this molten metal injecting process, the air or gas existing in the mold cavity 4 is evacuated through the opening 11 communicating with the atmosphere without excessive pressure and without applying any back pressure to the molten metal, because the opening 11 is formed to have a sufficiently large diameter. This process is illustrated in FIG. 2, wherein a limit switch 16 is engaged by the bottom plunger 6 but not actuated. Immediately before the completion of injection of the molten metal into the full space of the cavity 4, the bottom plunger 6 actuates the limit switch 16 which detects the final state of the upward movement of the bottom plunger 6. As shown in FIG. 2', when the limit switch 16 is actuated, the plunger 14 closes or occludes the opening 11 to prevent the scattering of the molten metal outside. With the further upward movement of the bottom plunger 6 with pressure, a part of the molten metal (M) fills up the space 12 above the mold cavity 4 and reaches the intermediate portion of the sleeve 13 so that the air or gas which has been existing in the mold cavity 4 is moved to and pressurized in the uppermost space in the sleeve 13 as illustrated in FIG. 3, thus completing the molten metal injecting process by the bottom plunger 6. Accordingly, the castings are free of excessive porosity or other defects otherwise caused by entrapped gases.

Figure 4:
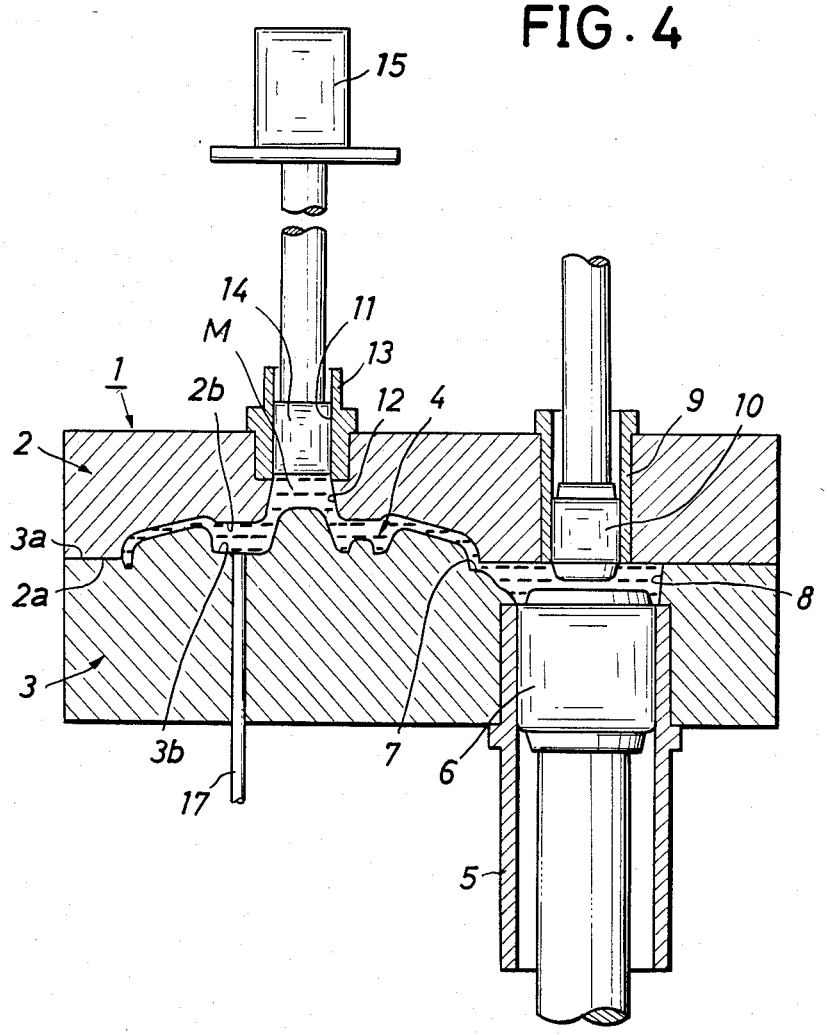
FIG. 4 is a view illustrating the stopping member pressurizing the injected molten metal in the mold cavity.

With the further downward movement of the plunger 14, the molten metal injected in the mold cavity 4 is pressurized so that additional molten metal is supplied from the space 12 into the cavity 4 according to the shrinkage due to the solidification of the molten metal in the mold cavity 4, which suppresses and prevents the formation of shrinkage cavities. At this stage, a detection of the timing for pressurizing of molten metal by the plunger 14 may be performed by a temperature sensor provided for the sleeve 13. This state is illustrated in FIG. 4. During the pressurizing operation of the plunger 14, the top plunger 10 may also be employed for pressurizing the molten metal in the mold cavity 4.

The pressurization of the molten metal in the mold cavity 4 may be embodied by the operation of the top and bottom plungers and the top and bottom sleeves need not necessarily be formed to have different diameters as shown in the drawings. In the drawings, reference numeral 17 designates an ejector pin for ejecting castings after the molten metal in the mold cavity has solidified and the mold elements are separated.

FIGS. 5 to 9, inclusive, illustrate a modified embodiment suitable for carrying out the method of the present invention. On the mating surfaces 102*a* and 103*a* of upper and lower mold elements 102 and 103 respectively of a vertical diecasting machine generally designated by reference numeral 101, a mold cavity 104 is formed between die surfaces 102*b* and 103*b*. The mold cavity 104 comprises a protruding part 104-2 and a substantially flat part 104-1. The mold cavity may comprise two mold cavities having a height difference therebetween and communicating via a runner. A pouring basin sleeve 105 is vertically fitted in a part of the lower mold element 103 and a space 108 is formed above the sleeve 105, the upper part of which is defined by the mating surface 102*c* of the upper mold element 102. The space 108 communicates with the mold cavity 104 by means of a runner 107. A plunger 106 is fitted in the sleeve 105. A molten metal supplying sleeve or sprue sleeve 109 extends diagonally at a slight angle from the side wall of the space 108, with the exit of the molten metal supplying sleeve 109 facing the upper end of the pouring basin sleeve 105. The molten metal supplying sleeve 109 projects outwardly sidewardly from the lower mold element 103 and is provided on its upper surface with a sprue hole 109*a*. A sealing means or plunger 110 is slidably fitted in the sleeve 109. Above the respective cavity parts 104-2 and 104-1 of the mold cavity 104, sleeves 113-2 and 113-1 are fitted in the upper mold element 102. Openings 111-2 and 111-1 of the sleeves 113-2 and 113-1 communicate with spaces 112-2 and 112-1 formed above the cavity parts 104-2 and 104-1 respectively. Stopping members 114-2 and 114-1, vertically operated by hydraulic cylinder units 115-2 and 115-1, are disposed above the openings 111-2 and 111-1 respectively. A molten metal (M) is poured into the pouring basin sleeve 105 through the sprue hole 109*a* with the plunger 110 retracted so that the poured molten metal is filled in the sleeve 105 on the upper surface of the plunger 106. In filling the sleeve 105 with the molten metal (M), the molten metal is supplied laterally and introduced into the sleeve 105 along the vertical wall thereof without directly dropping into the sleeve 105. Therefore, the molten metal flows gently and smoothly without any disturbance and without causing the inclusion of air in the molten metal.

Figure 5:
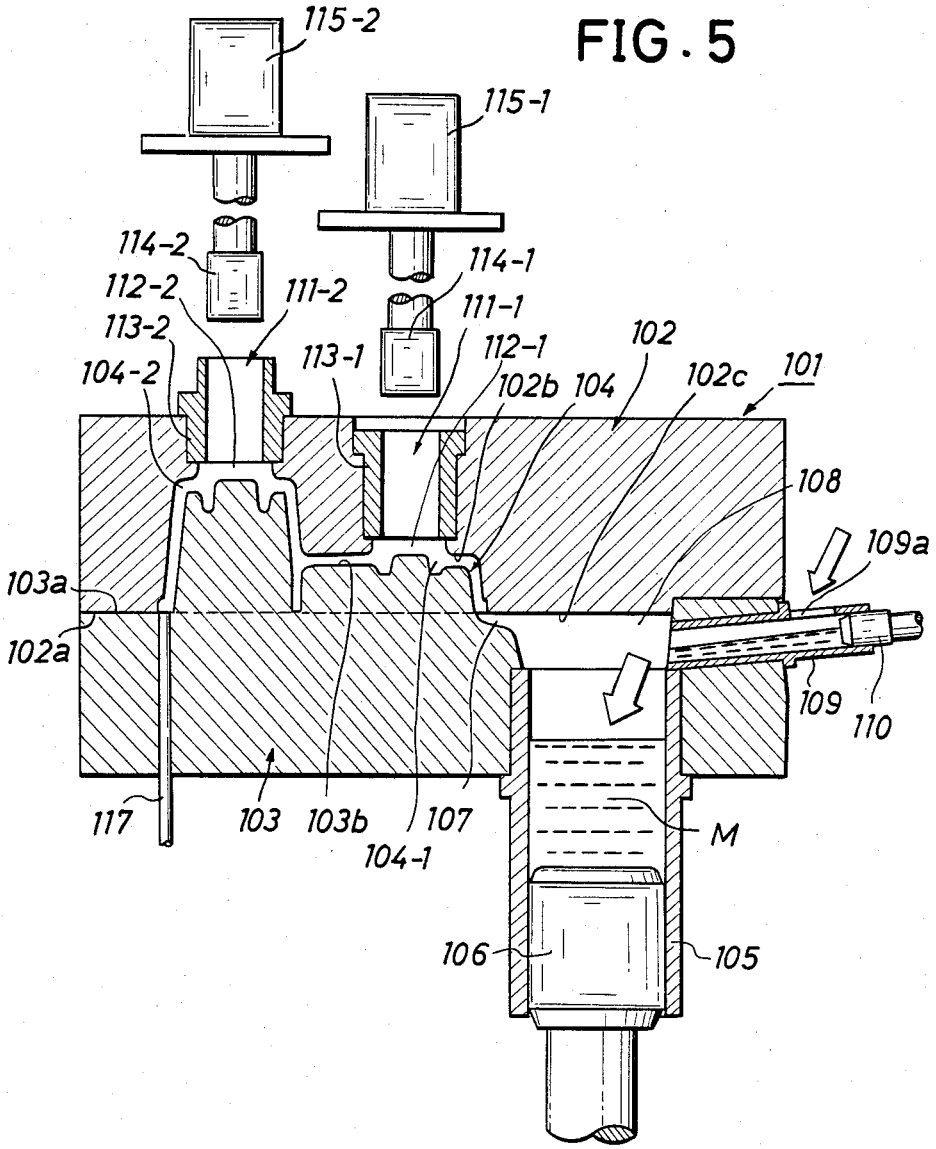
FIG. 5 is a vertical sectional view of a modified form of a vertical diecasting machine, similar to that of FIG. 1, for carrying out a modified method of the present invention.
Figure 6:
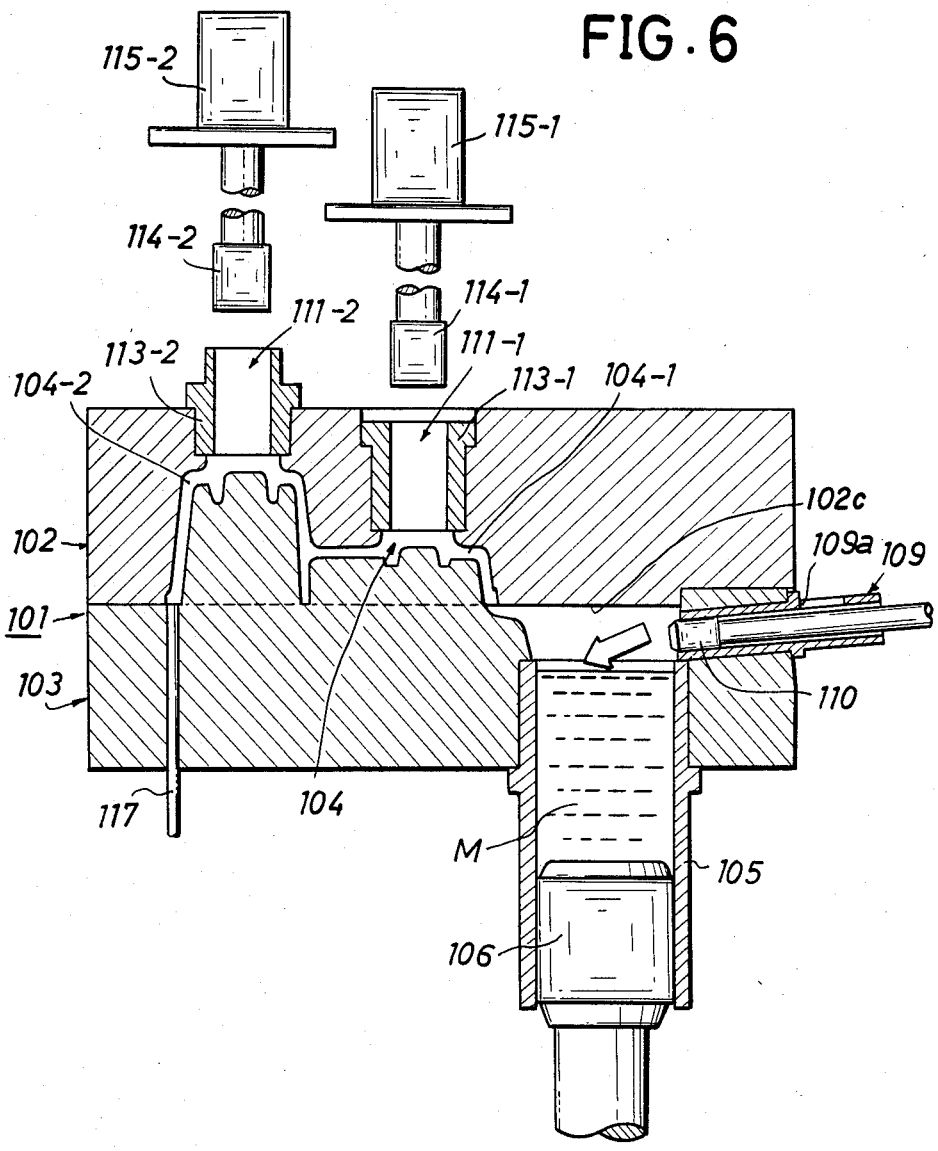
FIG. 6 is a view illustrating a molten metal filled in the sleeve of FIG. 5.
Figure 10:
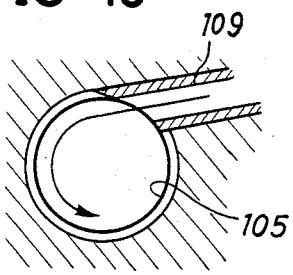
FIG. 10 is a plan view illustrating the manner of supplying a molten metal into the sleeve.

FIG. 5 illustrates the manner of pouring the molten metal as described hereinabove. The molten metal supplying sleeve 109 may be arranged diagonally and tangentially relative to the pouring basin sleeve 105 as shown in FIG. 10 to cause gentle and swirling flow of the molten metal in the pouring basin sleeve 105. After the pouring basin sleeve 105 has been filled with a predetermined amount of the molten metal, the plunger 110 advances to close the pouring sprue 109*a* and the exit of the molten metal supplying sleeve 109, thus completing the preparation for the injecting operation. This state is illustrated in FIG. 6.

Figure 7:
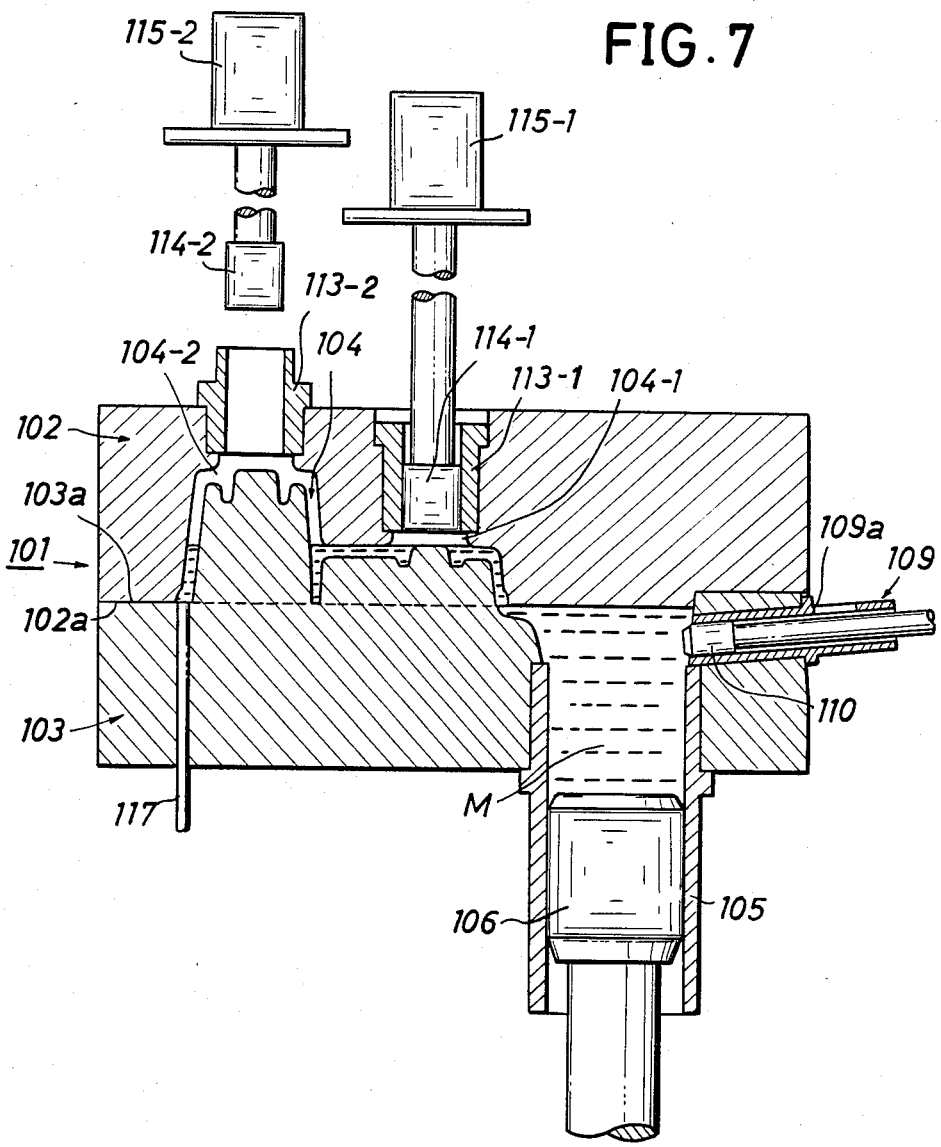
FIG. 7 is a view illustrating the vertical diecasting machine of FIG. 5 during injection of a molten metal.

In the next stage, the plunger 106 is raised to inject the molten metal (M) through the runner 107 first into the flat cavity part 104-1, then gradually into the protruding part 104-2, so that the gases produced during the injection are evacuated through the openings 111-1 and 111-2. At a suitable time before the flat cavity part 104-1 is filled up with the molten metal, the opening 111-1 of the flat cavity part 104-1 is closed by the stopping member 114-1. This state is illustrated in FIG. 7.

Figure 8:
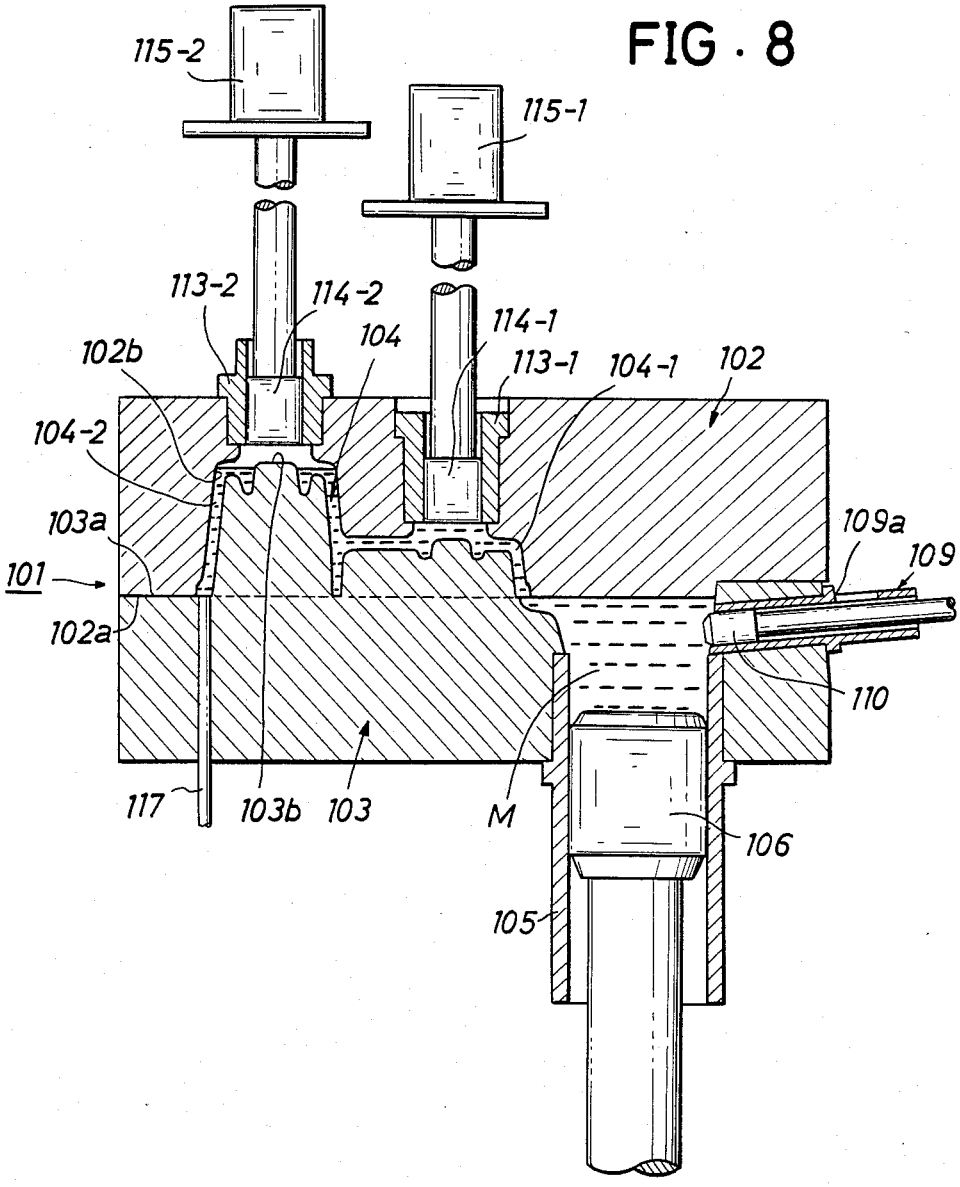
FIG. 8 is a view illustrating a plurality of mold cavities, one of which is filled with a molten metal and another of which is occluded by a stopping member.
Figure 9:
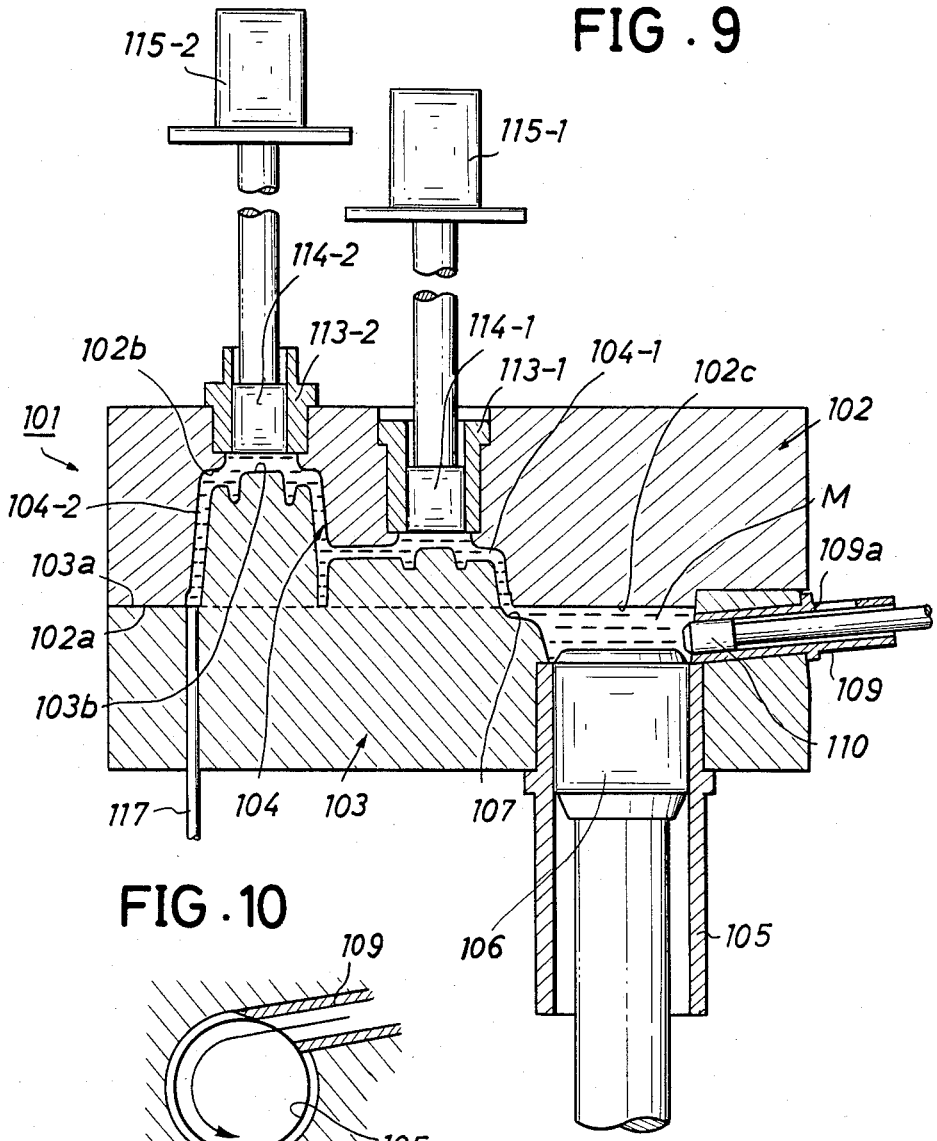
FIG. 9 is a view similar to FIG. 8, showing the molten metal filled in the mold cavities as pressurized by the respective stopping members.

With the further rising of the plunger 106, the molten metal flows into the protruding part 104-2 since the opening 111-1 of the flat part 104-1 is closed. The opening 111-2 of the protruding part 104-2 is also closed by the stopping member 114-2 at a suitable time. This state is illustrated in FIG. 8.

After a sufficient amount of the molten metal (M) has been thus injected in the mold cavity 104, the molten metal injected in the mold cavity 104 is pressurized by lowering the stopping members 114-1 and 114-2. This pressurization of the molten metal may be assisted by the operation of the plungers 106 and 110. Reference numeral 117 designates an ejector pin.

Although there have been described what are at present considered to be the preferred embodiments of the invention, it will be understood that the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A method of injecting a molten metal in a vertical diecasting machine, wherein said diecasting machine includes upper and lower mold elements which define a mold cavity; said upper mold element having at least one opening adapted to communicate said mold cavity with the atmosphere; said opening being closable by a sealing member; and said molten metal being injected into said mold cavity from a cylindrical, vertical pouring basin provided in said mold elements, by a plunger slidably fitted in said pouring basin, said method comprising the steps of:

opening said opening by movement of said sealing member when said mold elements are closed;

injecting said molten metal into said mold cavity by the upward movement of said plunger while said opening is open to the atmosphere;

closing said opening by said sealing member immediately before completion of the injection of said molten metal into said mold cavity; and thereafter completing the injection of said molten metal with pressure by further upward movement of said plunger.

2. A method of injecting a molten metal according to claim 1, further comprising:

pressurizing said molten metal injected into said mold cavity by means of said sealing member after completion of injection of said molten metal into said mold cavity by said plunger.

3. A method of injecting a molten metal according to claim 1, wherein:

said at least one opening of said upper mold element comprises at least two openings which are closed simultaneously by respective sealing members, immediately before completion of injection of said molten metal into said mold cavity by said plunger.

4. A method of injecting a molten metal according to claim 1, wherein:

said at least one opening of said upper mold element comprises at least two openings which are closed at different respective times by respective sealing members, immediately before completion of injection of said molten metal into said mold cavity by said plunger.

* * * * *